US010937580B2

(12) United States Patent
Xu

(10) Patent No.: US 10,937,580 B2
(45) Date of Patent: Mar. 2, 2021

(54) AMORPHOUS ALLOY TRANSFORMER IRON CORE OF THREE-DIMENSIONAL TRIANGLE STRUCTURE

(71) Applicant: Haihong Electric Co., Ltd., Kaiping (CN)

(72) Inventor: Kaixuan Xu, Kaiping (CN)

(73) Assignee: Haihong Electric Co., Ltd., Kaiping (CN)

( * ) Notice: Subject to any disclaimer, the term of this patent is extended or adjusted under 35 U.S.C. 154(b) by 225 days.

(21) Appl. No.: 16/171,243

(22) Filed: Oct. 25, 2018

(65) Prior Publication Data

US 2019/0131041 A1 May 2, 2019

Related U.S. Application Data

(63) Continuation of application No. 14/372,634, filed as application No. PCT/CN2012/076604 on Jun. 7, 2012, now abandoned.

(30) Foreign Application Priority Data

May 28, 2012 (CN) ..... 201210167698.7

(51) Int. Cl.

| | |
|---|---|
| ***H01F 7/06*** | (2006.01) |
| ***H01F 3/04*** | (2006.01) |
| ***H01F 27/26*** | (2006.01) |
| ***H01F 41/02*** | (2006.01) |

(52) U.S. Cl.
CPC ..... *H01F 3/04* (2013.01); *H01F 27/263* (2013.01); *H01F 41/0226* (2013.01)

(58) Field of Classification Search
CPC ..... H01F 3/04; H01F 27/263; H01F 41/0226; Y10T 29/4902; Y10T 29/49073
USPC ..... 29/602.1, 606
See application file for complete search history.

(56) References Cited

U.S. PATENT DOCUMENTS

| | | | | |
|---|---|---|---|---|
| 4,557,039 | A * | 12/1985 | Manderson | H01F 41/0213 29/605 |
| 6,809,620 | B2 * | 10/2004 | Hoglund | H01F 3/06 336/213 |
| 8,653,929 | B2 * | 2/2014 | Xu | H01F 27/263 336/210 |

FOREIGN PATENT DOCUMENTS

| | | |
|---|---|---|
| CN | 2562322 | 7/2003 |
| CN | 200959265 Y | 10/2007 |
| CN | 101150006 A | 3/2008 |
| CN | 102362321 A | 2/2012 |

* cited by examiner

*Primary Examiner* — Donghai D Nguyen
(74) *Attorney, Agent, or Firm* — Loginov & Associates, PLLC; William A. Loginov

(57) ABSTRACT

An amorphous alloy transformer iron core of a three-dimensional triangle structure belongs to the technical field of electrical devices. The amorphous alloy transformer iron core of the three-dimensional triangle structure is formed by piecing three identical rectangular single frames whose sections are approximately semicircular. A manufacturing method thereof comprises steps of cutting, winding, assembling, annealing and molding. The amorphous alloy transformer iron core of the three-dimensional triangle structure has the advantages of saving materials, reducing loss and noise, balancing three phases, enabling coils not to be sleeved, and being stable in performance and strong in anti-short circuit capacity.

1 Claim, 5 Drawing Sheets

AMORPHOUS ALLOY TRANSFORMER IRON CORE OF THREE-DIMENSIONAL TRIANGLE STRUCTURE

FIELD OF THE INVENTION

This invention relates to a triangular amorphous alloy 3D core transformer, especially the manufacturing method of its core.

BACKGROUND OF THE INVENTION

Energy saving is an essential national policy of China to construct a conservation-oriented society. Due to the remarkable ability of amorphous alloy transformer to save energy and protect the environment, it has been gradually accepted by the majority of users and becomes an ideal new generation of distribution transformer. Currently, three-phase five-limb planar wound core and three-phase three-limb planar wound core are applied in amorphous alloy transformer on the market. The cross section of these two kinds of planar amorphous alloy cores for transformer is rectangle. It has disadvantages like huger size of core, heavier overall weight, and longer processing time. Additionally, the size design of transformer is prone to be restricted by amorphous alloy sheet width. The design and manufacture are inflexible. The cost of the amorphous alloy core above is higher.

Theoretically, both three-phase five-limb and three-phase three-limb are in planar structure, in which the lengths of magnetic circuits are unequal. Consequently, three-phase electric power distribution may be not symmetrical. Additionally, lots of seams on the upper or lower yoke may form an area of high energy consumption. Thus, it could not take full advantage of the strong magnetic conductibility of the amorphous alloy. And the air gaps in the seams may increase corresponding loss. The rectangular core and coil of transformer may lead to the weak ability to withstand short-circuit of the product.

SUMMARY OF THE INVENTION

This invention is to present a triangular amorphous alloy 3D core for transformer whose cost is lower than the traditional one and performance is optimal.

This invention is realized by a triangular amorphous alloy 3D core for transformer made of three identical rectangle frames with approximate semicircular cross section, wherein its manufacturing method is comprised by following steps:

(1)

Slitting

Slit the rectangular amorphous alloy strips in fixed width into trapezoid strips;

(2)

Winding

Rectangular mould as inner support, starting from the first stage winding of the single frame, trapezoid strip is wound layer by layer from inside out, and then make trapezoid strips in the winding machine follow the given direction, as a result, its upper and lower parts are outwardly inclined;

After completion of the required thickness of the first stage winding, at the second stage, strip in another size is wound on outer layer of the first stage winding, and then other required thickness of the winding is consecutively achieved in the same way;

(3)

Assembling

A whole amorphous alloy core is made of three identical single frames (FIG. 3), because the cross section of two limbs of every single frame is approximate semicircular, after combination and fixation of the limbs of three single frames, the circular core limb is constituted;

(4)

Annealing

The annealing of the assembled triangular 3D core is finished in annealing oven in order to relieve the internal stress, recover the magnetism, and further improve the performance of core;

(5)

Molding

Tie the combined core limbs with insulation banding tape after aligning of the core to make the core to be a firm entirety.

The characteristic of the triangular amorphous alloy 3D core for transformer is that the cross section of the rectangular single frame is approximately semicircular.

This invention relates to a triangular amorphous alloy 3D core for transformer. In structure, triangular amorphous alloy 3D core for transformer is made of three identical single frames with approximate semicircular cross section through special technique after combination of them. The cross sections of the three core limbs are approximate circular. And every single frame is wound with several sizes of amorphous alloy trapezoid strips consecutively and tightly to form a semicircular cross section. Compared with the traditional amorphous alloy core, the yoke of triangular amorphous alloy 3D core is more than 20% lighter, and its angle parts are lighter. Consequently, the consumption of amorphous alloy is greatly diminished. Moreover, there is no seam in the yoke of triangular amorphous alloy 3D core. Therefore, there is no need to open the yoke and then close it, and the coil of transformer could be wound directly around the core limbs. Consequently, the processing time is shorter and efficiency of labor is raised.

In performance, magnetic conduction direction of the amorphous alloy strips is exactly the same with the magnetic circuit direction of the core, which greatly minimizes vibration and solves the problem of noise in traditional amorphous alloy. Moreover, the three-phase magnetic circuit of core is completely symmetrical and of equal length. Consequently, three-phase electric power distribution is able to be symmetrical and magnetic reluctance and magnetizing current are significantly reduced. Besides, there is no seam in the yoke of triangular amorphous alloy 3D core for transformer, so there is no high energy consumption area. Thus, it could take full advantage of the strong magnetic conductibility of the amorphous alloy and loss resulted from the air gaps in seam is minimized. Furthermore, there is a sharp decline in no-load loss of the triangular amorphous alloy 3D core for transformer because no-load loss is directly proportional to the weight of core. Additionally, the cross section of three core limbs in this kind of amorphous alloy transformer is approximate circular, and the coil is approximate circular as well. The combination of them enormously improves the ability of the amorphous alloy 3D core transformer to withstand short circuit.

DETAILED DESCRIPTION

Figure 1:
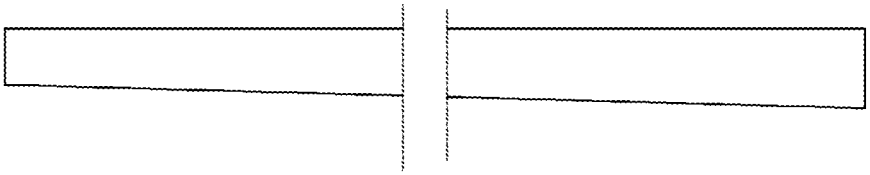
FIG. 1 is front view of the trapezoid strip of this invention.

A full and enabling discourse of this invention, integrating the appended figures, is set forth in the specification, in which:

Showing in FIG. 1, a triangular amorphous alloy 3D core for transformer is made of three identical rectangle frames with approximate semicircular cross section, Wherein its manufacturing method is comprised by following steps:

(1)

Slitting

The thickness of amorphous alloy material is usually 0.025 mm. Slit the rectangular amorphous alloy strips in fixed width into several sizes of trapezoid strips in the shape showing in FIG. 1.

(2)

Winding

Figure 2:
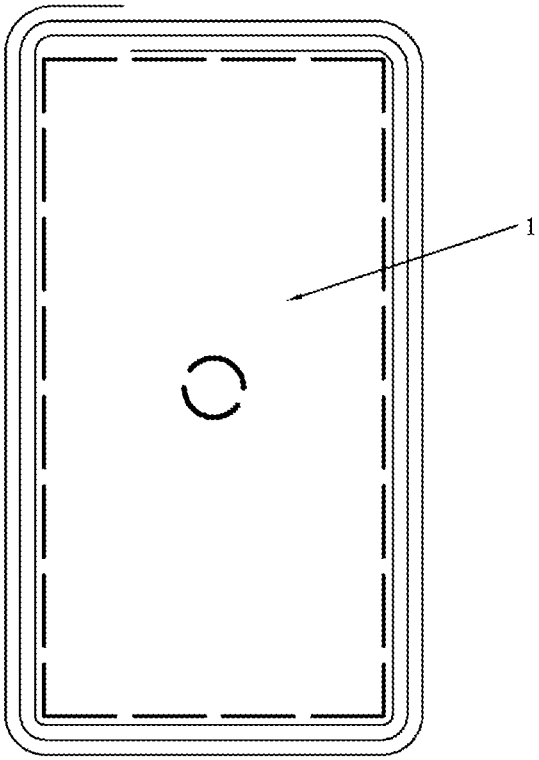
FIG. 2 is the winding of single frame of this invention.
Figure 3:
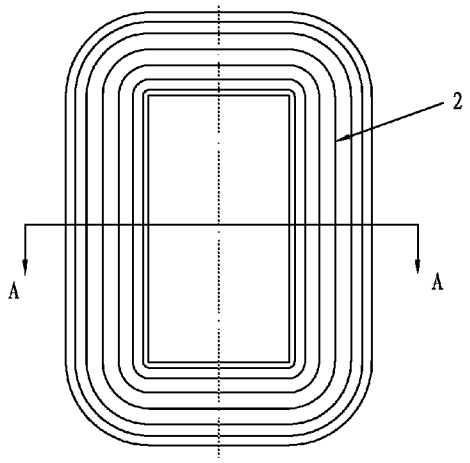
FIG. 3 is front view of the single frame of this invention.
Figure 4:
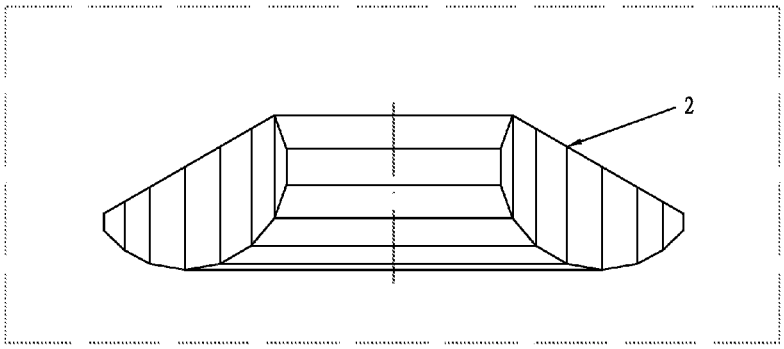
FIG. 4 is A-A section view of FIG. 3.
Figure 5:
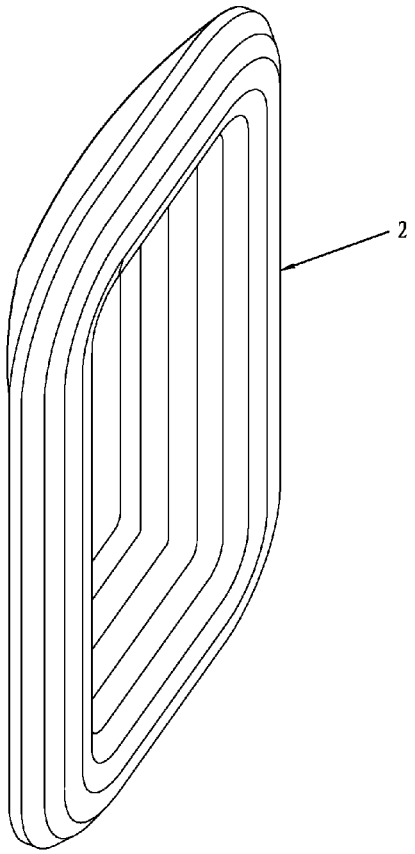
FIG. 5 is 3D view of the single frame of this invention.
Figure 6:
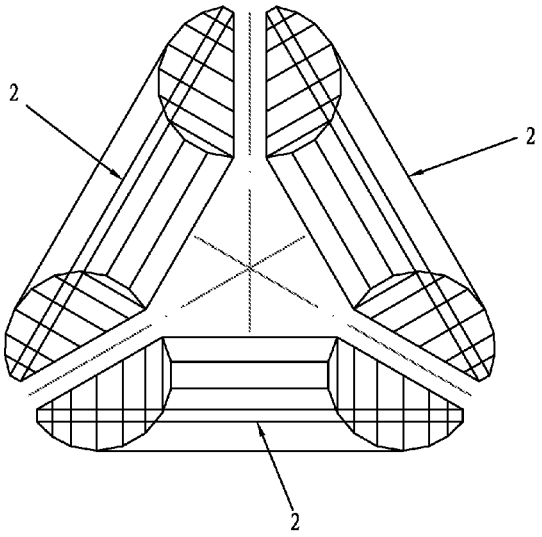
FIG. 6 is vertical view of single frame before combination of this invention.

Rectangular mould 1, showing in FIG. 2, as inner support, starting from the first stage winding of the single frame, trapezoid strip is wound layer by layer from the inside out and make trapezoid strips in the winding machine follow the given direction, as a result, its upper and lower parts are outwardly inclined; after completion of the required thickness of the first stage winding, at the second stage, strip in another size is wound on outer layer of the first stage winding, and then other required thickness of the winding is consecutively achieved in the same way; if it is a seven-stage single frame, then seven sizes of trapezoid strips are required, in addition, the width of the head of latter strip is the same as that of the end of the former and the thickness of each stage winding may not be the same; FIG. 3 is front view of finished single frame; FIG. 4 is section view of cross section of single frame; FIG. 5 is side view of single frame.

(3)

Assembling

Figure 7:
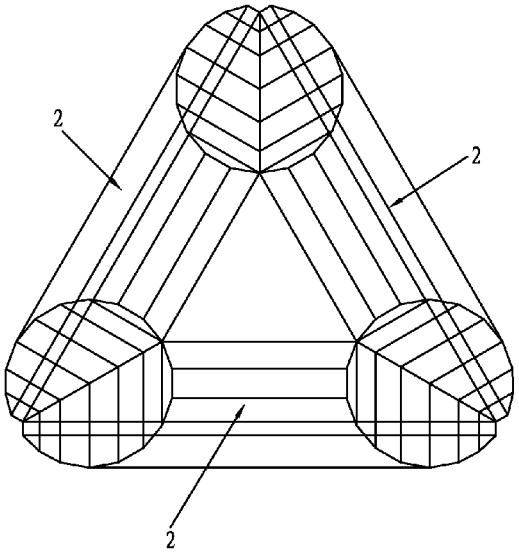
FIG. 7 is vertical view of amorphous alloy 3D core of this invention.

A whole amorphous alloy core is made of three identical single frames 2, showing in FIG. 3, and the cross section of two limbs of every single frame 2 is approximate semicircular, which constitutes the approximate circular core limb 3 after combination and fixation of the limbs of three single frames 2; FIG. 7 is vertical view of combined triangular amorphous alloy 3D core; in FIG. 8, 2 indicates upper yoke and 4 indicates lower yoke.

(4)

Annealing

The annealing of the assembled triangular 3D core is finished in annealing oven in order to relieve the internal stress, recover the magnetism, and further improve the performance of core.

(5)

Molding

Figure 8:
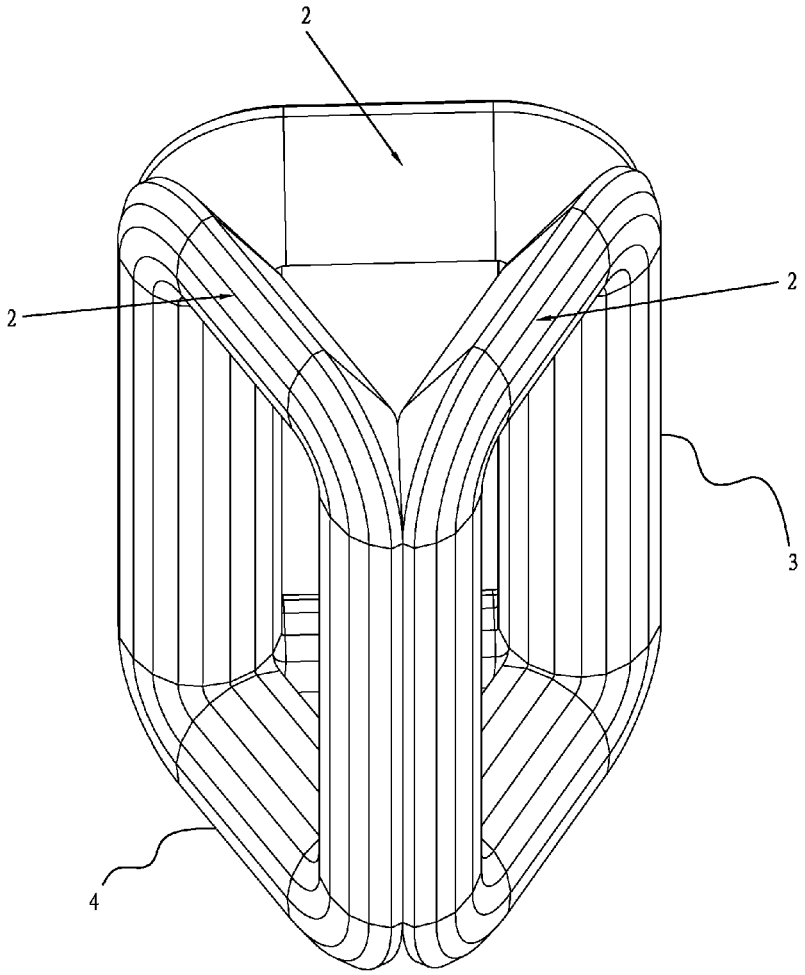
FIG. 8 is 3D view of amorphous alloy 3D core of this invention.

Tie the combined core limbs with insulation banding tape after aligning of the core to make the core to be a firm entirety, shown in FIG. 8.

FIG. 8 is 3D view of finished triangular amorphous alloy 3D core for transformer. As FIG. 8 illustrates, three single frames form the three core limb, which are in the structure of triangular prism. And the cross sections of core limbs are approximate circular.

The thickness of amorphous alloy material is usually 0.025 mm. It is hard and brittle. This invention adopts special technique, instrument, and equipment in order to overcome the difficulties in slitting amorphous alloy material and manufacture of amorphous alloy 3D core.

The embodiment described above is just the prior one. It should be noticed that for general technical staff in this field, several improvement and modification may be made without departing from the principles of the case, which are also considered as the protection scope of the invention.

The invention claimed is:

1. A method for manufacturing a triangular amorphous alloy 3D core for transformer made of three identical rectangle frames with approximately semicircular cross section, comprising:

slitting a rectangular amorphous alloy strip with a fixed width into a plurality of trapezoid strips with different sizes;

winding, by starting from a first stage winding of each of the three identical rectangle frames and using a rectangular module as inner support, a first trapezoid strip of the plurality of the trapezoid strips by layer from inside out and moving the trapezoid strip on a winding machine in a given direction, to form a shape with an upper portion of the rectangle frame and a lower portion of the rectangle frame outwardly inclined, wherein a cross section line taken through a side of the rectangle frame that divides the rectangle frame into two rectangles divides the rectangle frame into the upper portion and the lower portion;

after reaching a required thickness of the first stage winding, at a second stage, winding a second trapezoid strip of the plurality of the trapezoid strips having a different size from the first trapezoid strip on an outer layer of the first stage winding to form a thickness of the second stage winding, and then consecutively winding and forming a plurality of stage windings, wherein widths of the plurality of stage windings are different from each other;

combining and fixing limbs of three single frames each having two approximately semicircular cross section of two limb in order to constitute a circular core limb;

conducting annealing for the assembled triangular 3D core with an annealing oven in order to relieve the internal stress, recover the magnetism, and further improve a performance of core;

tying the combined core limbs with an insulation banding tape after aligning of the core to make the core to be a firm entirety.

* * * * *